US008918915B2

(12) United States Patent
Caulfield et al.

(10) Patent No.: US 8,918,915 B2
(45) **Date of Patent: *Dec. 30, 2014**

(54) GARMENT WITH TETHERING SYSTEM

(71) Applicants: Frances Caulfield, Basking Ridge, NJ (US); Nancy Farkas, New York, NY (US)

(72) Inventors: Frances Caulfield, Basking Ridge, NJ (US); Nancy Farkas, New York, NY (US)

(73) Assignee: Little Black, LLC, Westbury, NY (US)

( * ) Notice: Subject to any disclaimer, the term of this patent is extended or adjusted under 35 U.S.C. 154(b) by 33 days.

This patent is subject to a terminal disclaimer.

(21) Appl. No.: 13/900,941

(22) Filed: May 23, 2013

(65) Prior Publication Data

US 2014/0101815 A1 Apr. 17, 2014

Related U.S. Application Data

(63) Continuation-in-part of application No. 13/803,979, filed on Mar. 14, 2013, now Pat. No. 8,739,314.

(60) Provisional application No. 61/712,367, filed on Oct. 11, 2012.

(51) Int. Cl.
*A41D 7/00* (2006.01)
*A41F 17/00* (2006.01)

(52) U.S. Cl.
CPC ..... *A41F 17/00* (2013.01); *A41D 7/005* (2013.01)
USPC ..... 2/67

(58) Field of Classification Search
USPC ..... 2/67, 70–73, 111–113, 102, 69, 79, 2/92–94, 44, 456, 307–310, 312, 228, 2/238, 227
See application file for complete search history.

(56) References Cited

U.S. PATENT DOCUMENTS

| | | | | |
|---|---|---|---|---|
| 1,172,615 | A * | 2/1916 | Lelansky | 2/70 |
| 2,671,218 | A | 3/1954 | Luhr | |
| 2,725,565 | A * | 12/1955 | Wyner | 2/70 |
| 2,857,600 | A | 10/1958 | Finn | |
| 3,418,659 | A * | 12/1968 | Brown | 2/70 |
| 4,947,489 | A * | 8/1990 | Greenwood | 2/304 |
| 5,095,549 | A * | 3/1992 | Aldridge | 2/304 |
| 5,717,998 | A | 2/1998 | Everett | |
| 6,016,569 | A | 1/2000 | Everett | |
| 6,374,412 | B1 | 4/2002 | Canlas | |
| 7,047,567 | B2 * | 5/2006 | Allen | 2/69 |
| 8,011,019 | B1 * | 9/2011 | Hamid et al. | 2/69 |
| 8,051,496 | B2 | 11/2011 | Hersh | |
| 8,739,314 | B2 * | 6/2014 | Caulfield et al. | 2/70 |

* cited by examiner

*Primary Examiner* — Tejash Patel
(74) *Attorney, Agent, or Firm* — Greenberg Traurig, LLP

(57) ABSTRACT

A garment includes an outer garment having a shorts portion with an inner side and a pair of elastic tethers having first fastening elements, and an undergarment having a front panel and a pair of second fastening elements. Each of the first fastening elements of the tethers of the shorts portion is adapted to engage releasably a corresponding one of the second fastening elements of the undergarment. The first and second fastening elements may include snap elements, buttons, pins, zippers, or hook and loop fasteners.

14 Claims, 7 Drawing Sheets

GARMENT WITH TETHERING SYSTEM

CROSS-REFERENCE TO RELATED APPLICATION

This application is a continuation-in-part application relating to and claiming the benefit of commonly owned, co-pending U.S. patent application Ser. No. 13/803,979 entitled GARMENT WITH TETHERING SYSTEM, filed on Mar. 14, 2013, which claims the benefit of U.S. Provisional Patent Application Ser. No. 61/712,367 entitled "BATHING DRESS WITH TETHERING SYSTEM," filed Oct. 11, 2012, the entireties of which are incorporated herein by reference.

FIELD OF THE INVENTION

The present invention relates to garments and, more particularly, to garments having a tethering system for attaching an outer garment to an undergarment.

BACKGROUND OF THE INVENTION

Some garments, such as dresses, bathing suits, and bathing dresses, include an outer garment and an undergarment. What is needed is a system that maintains the garment's aesthetic look and function.

SUMMARY OF THE INVENTION

In an embodiment, a garment, comprising an outer garment having a shorts portion with an inner side and a pair of tethers extending from said inner side, each of said tethers including a first end and a second end opposite said first end, said first ends of said tethers being attached to said shorts portion of said outer garment, and each of said tethers including a first fastening element located at said second end thereof; and an undergarment having a pair of second fastening elements, wherein each of said first fastening elements of said tethers of said shorts portion is adapted to engage releasably a corresponding one of said second fastening elements of said undergarment.

In an embodiment, each of said tethers is made from an elastic material. In an embodiment, said shorts portion includes a first side seam located on said inner side, and a second side seam located on said inner side and opposite said first side seam, wherein one of said pair of tethers is attached to said first side seam of said shorts portion, and the other of said pair of tethers is attached to said second side seam of said shorts portion. In an embodiment, the undergarment includes a front panel, and wherein said second fastening elements are positioned on said front panel. In an embodiment, the undergarment includes a rear panel opposite said front panel, said front and rear panels forming left and right side portions, a waist portion, and left and right leg openings, and wherein one of said pair of second fastening elements is positioned proximate to said left side portion intermediate said waist portion and said left leg opening, and the other of said pair of second fastening elements is positioned proximate to said right side portion intermediate said waist portion and said right leg opening. In an embodiment, each of said first fastening elements of said tethers of said shorts portion of said outer garment includes a female snap element, and each of said second fastening elements of said undergarment includes a male snap element. In an embodiment, each of said first fastening elements of said tethers of said shorts portion of said outer garment includes a male snap element, and each of said second fastening elements of said undergarment includes a female snap element. In an embodiment, each of said first fastening elements of said tethers of said shorts portion of said outer garment and said second fastening elements of said undergarment are selected from the group consisting of buttons, hook and eye fasteners, pins, zippers, and hook and loop fasteners. In an embodiment, the garment is a men's swimsuit. In an embodiment, the garment is men's shorts.

DETAILED DESCRIPTION OF THE DRAWINGS

Figure 2:
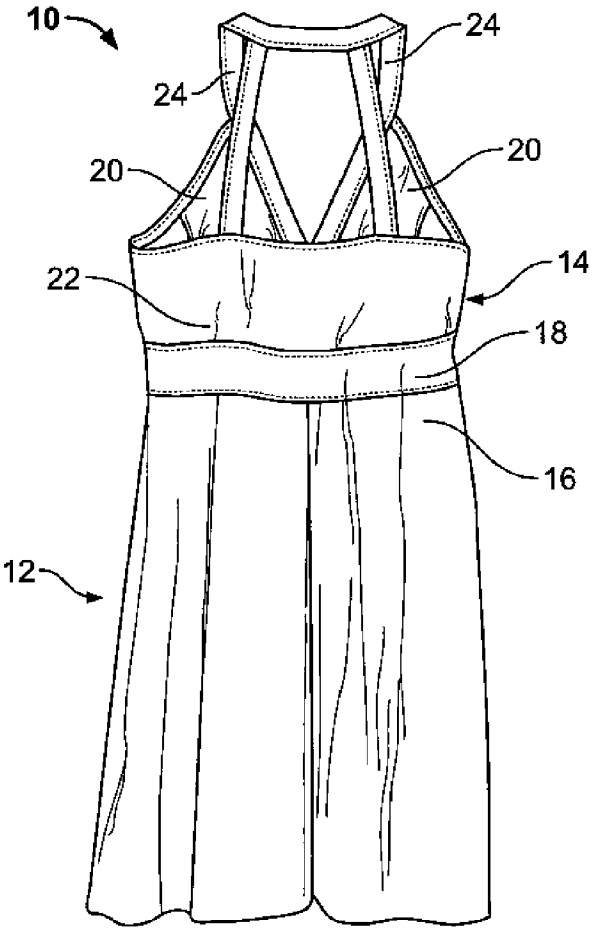
FIG. 2 is a rear elevational view of the garment shown in FIG. 1.
Figure 1:
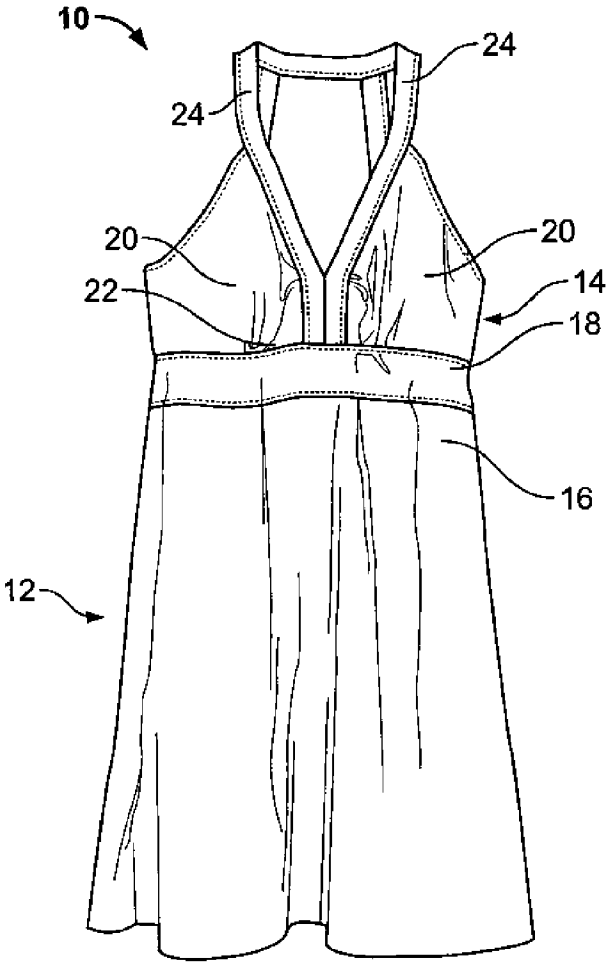
FIG. 1 is a front elevational view of a garment constructed in accordance with an embodiment of the present invention.

FIGS. 1 and 2 show a garment 10 constructed in accordance with an embodiment of the present invention. In an embodiment, the garment 10 is a dress. In another embodiment, the garment 10 is a bathing dress. In an embodiment, the garment 10 includes an outer garment 12 having a bust portion 14, a skirt portion 16 attached to and extending downwardly from the bust portion 14, and a waist band 18 formed around the periphery at the points of attachment of the bust portion 14 to the skirt portion 16. In an embodiment, the bust portion 14, the skirt portion 16, and the waist band 18 are attached to one another by stitching, sewing or other means known the art. In an embodiment, the waist band 18 is elastic. In an embodiment, the bust portion 14 includes bra cups 20, padding 22 and straps 24. In other embodiments, the bust portion 14 consists of other designs, styles, shapes and sizes. In an embodiment, the skirt portion 16 includes a length that covers a substantial portion of a user's legs. In other embodiments, the skirt portion 16 includes a length that terminates either below the user's knees or above the knees. In an embodiment, the skirt portion 16 is characterized by an A-line cut. In other embodiments, the skirt portion 16 consists of other designs, styles, shapes and sizes.

Figure 3:
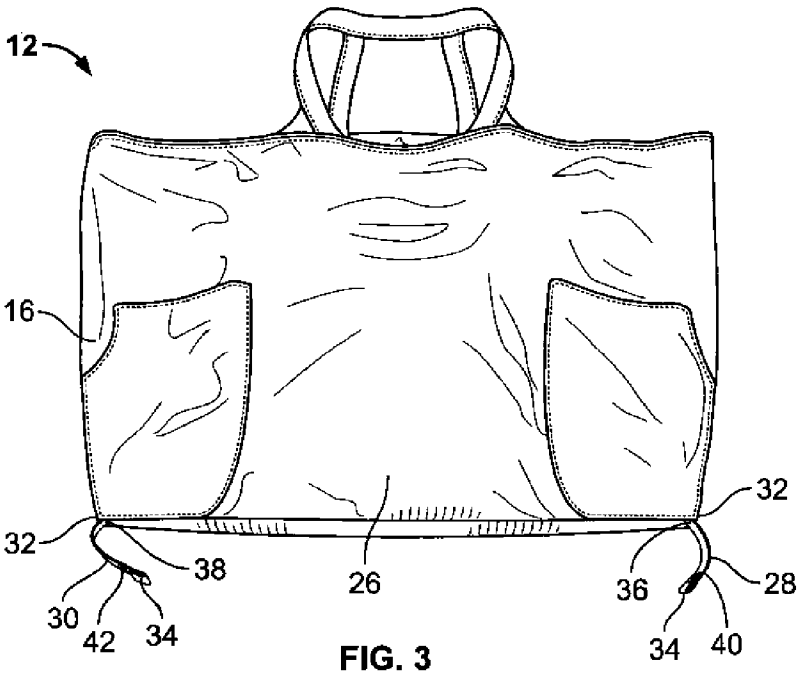
FIG. 3 is a front elevational view of the garment shown in FIG. 1, with a skirt portion of an outer garment employed by the garment rolled up to reveal a pair of tethers.

Referring to FIG. 3, an inner side 26 of the outer garment 12 includes a pair of tethers 28, 30 extending therefrom. In an embodiment, the tethers 28, 30 are diametrically opposed to one another. In an embodiment, each of the tethers 28, 30 includes a first end 32 and a second end 34 opposite the first end 32. In an embodiment, the first end 32 of the tether 28 is attached to a first side seam 36 of the skirt portion 16, while the first end 32 of the tether 30 is attached to a second side seam 38 of the skirt portion 16. In an embodiment, the tethers 28, 30 are stitched to the first and second side seams 36, 38, respectively. In an embodiment, the tethers 28, 30 are attached to the first and second side seams 36, 38, respectively, at locations proximate to the hip of the user when she wears the garment 10. In other embodiments, the tethers 28, 30 are attached to the inner side 26 of the outer garment 12 at other suitable locations. In an embodiment, the tethers 28, 30 are flexible and made from an elastic material. In other embodiments, the outer garment 12 may include more than two of the tethers 28, 30. In another embodiment, the outer garment 12 includes at least one of the tethers 28, 30. In an embodiment, each of the tethers 28, 30 includes a first fastening element 40, 42, respectively, at the second end 34 thereof. In an embodiment, each of the first fastening elements 40, 42 includes a female snap element, as shown in the Figures. In another embodiment, each of the first fastening elements 40, 42 includes a male snap element.

Figure 4A:
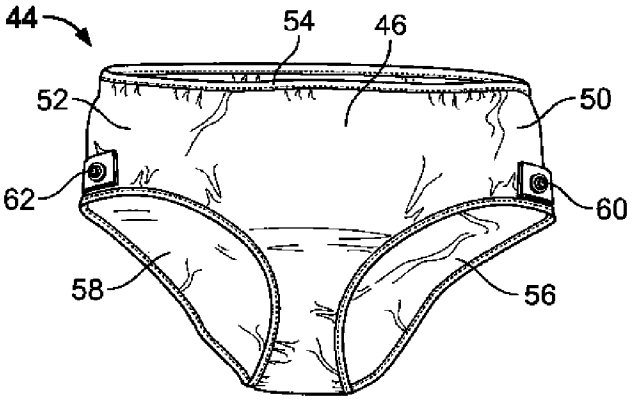
FIGS. 4A and 4B are front and rear elevational views, respectively, of an undergarment employed by the garment shown in FIGS. 1 and 2.
Figure 4B:
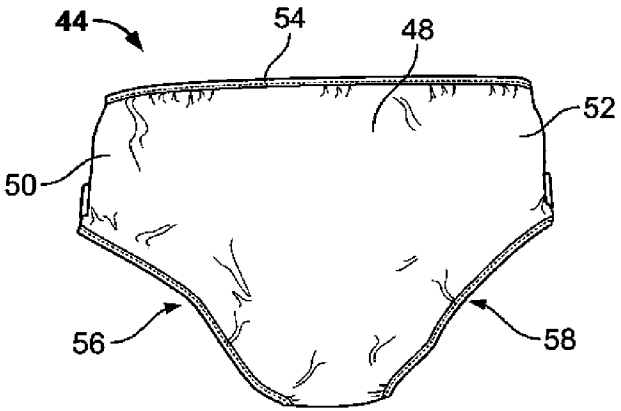

Referring to FIGS. 4A and 4B, the garment 10 includes an undergarment 44 having a front panel 46 and a rear panel 48 opposite the front panel 46, which form left and right side portions 50, 52, a waist portion 54, and leg openings 56, 58. In an embodiment, the undergarment 44 is a panty. In an embodiment, the front panel 46 includes a pair of second fastening elements 60, 62. In an embodiment, the second fastening element 60 is positioned on the left side portion 50 intermediate the waist portion 54 and the leg opening 56, while the second fastening element 62 is positioned on the right side portion 52 intermediate the waist portion 54 and the leg opening 58. In an embodiment, each of the second fastening elements 60, 62 includes a male snap element, as shown in the Figures. In another embodiment, each of the second fastening elements 60, 62 includes a female snap element. In an embodiment, the second fastening element 60 (e.g., a male snap element as shown in the Figures) is sized and shaped to be engaged removably with the first fastening element 40 (e.g., a female snap element as shown in the Figures) of the tether 28 of the outer garment 12, while the second fastening element 62 (e.g., a male snap element) is sized and shaped to be engaged removably with the first fastening element 42 (e.g., a female snap element) of the tether 30 of the outer garment 12. In other embodiments, each of the first fastening elements 40, 42 and the second fastening elements 60, 62 includes other fastening elements and systems known in the art, such as buttons/buttonholes, hook and eye fasteners, zippers, pins, and VELCRO™ hook and loop fasteners.

In an embodiment, the outer garment 12 and the undergarment 44 are made from Proflex nylon. In another embodiment, the outer garment 12 and/or the undergarment 44 are made from antimicrobial fabric materials. In other embodiments, the outer garment 12 and the undergarment 44 may be made from other suitable materials for swimwear known in the art.

Figure 5:
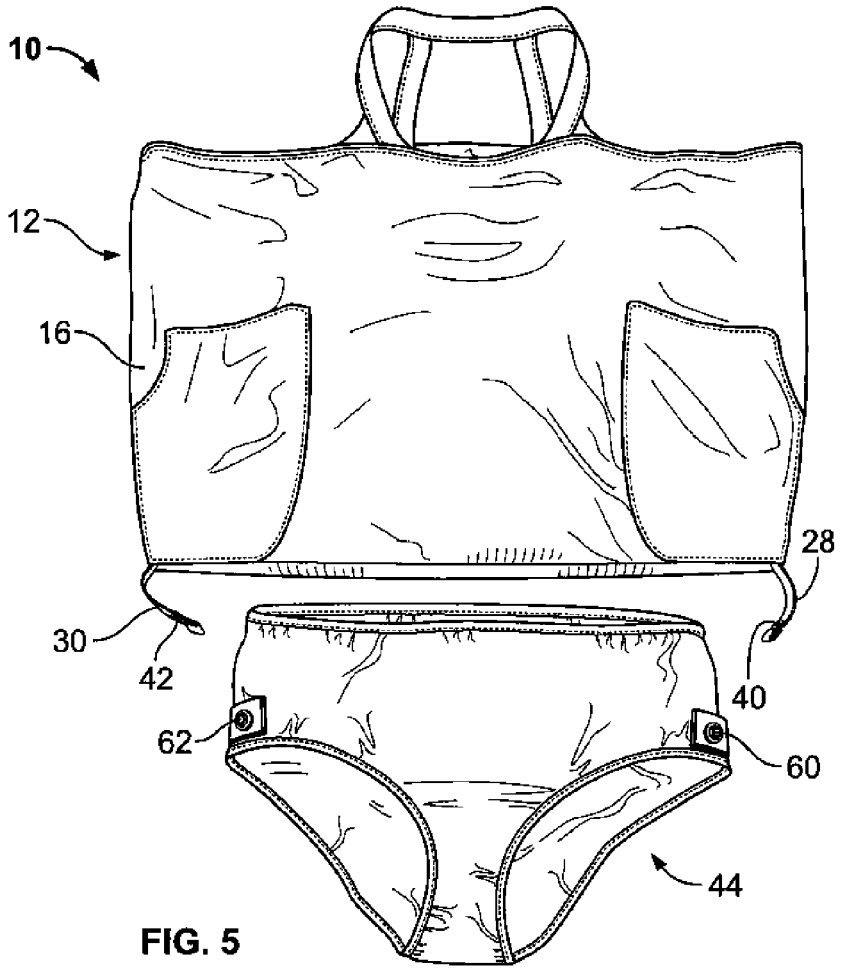
FIG. 5 is an exploded front elevational view of the garment shown in FIGS. 1 through 4B.
Figure 6:
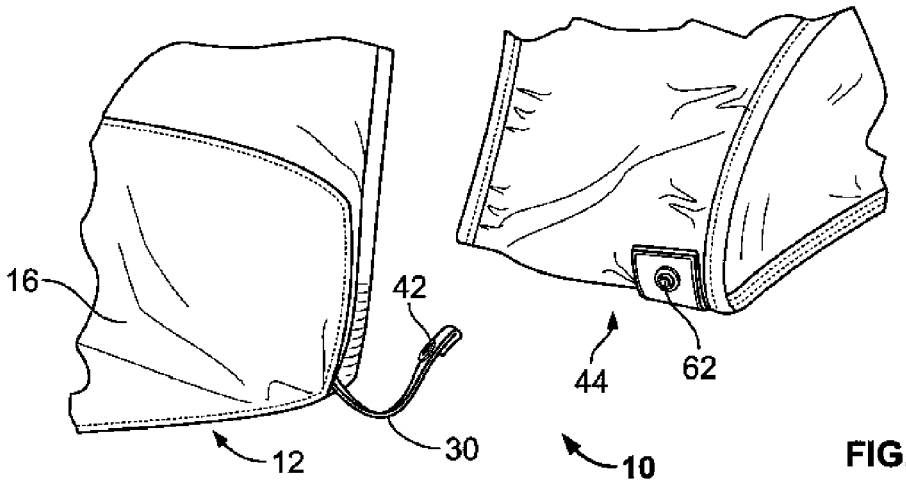
FIG. 6 is an illustration of a tethering system employed by the garment shown in FIG. 5.
Figure 7:
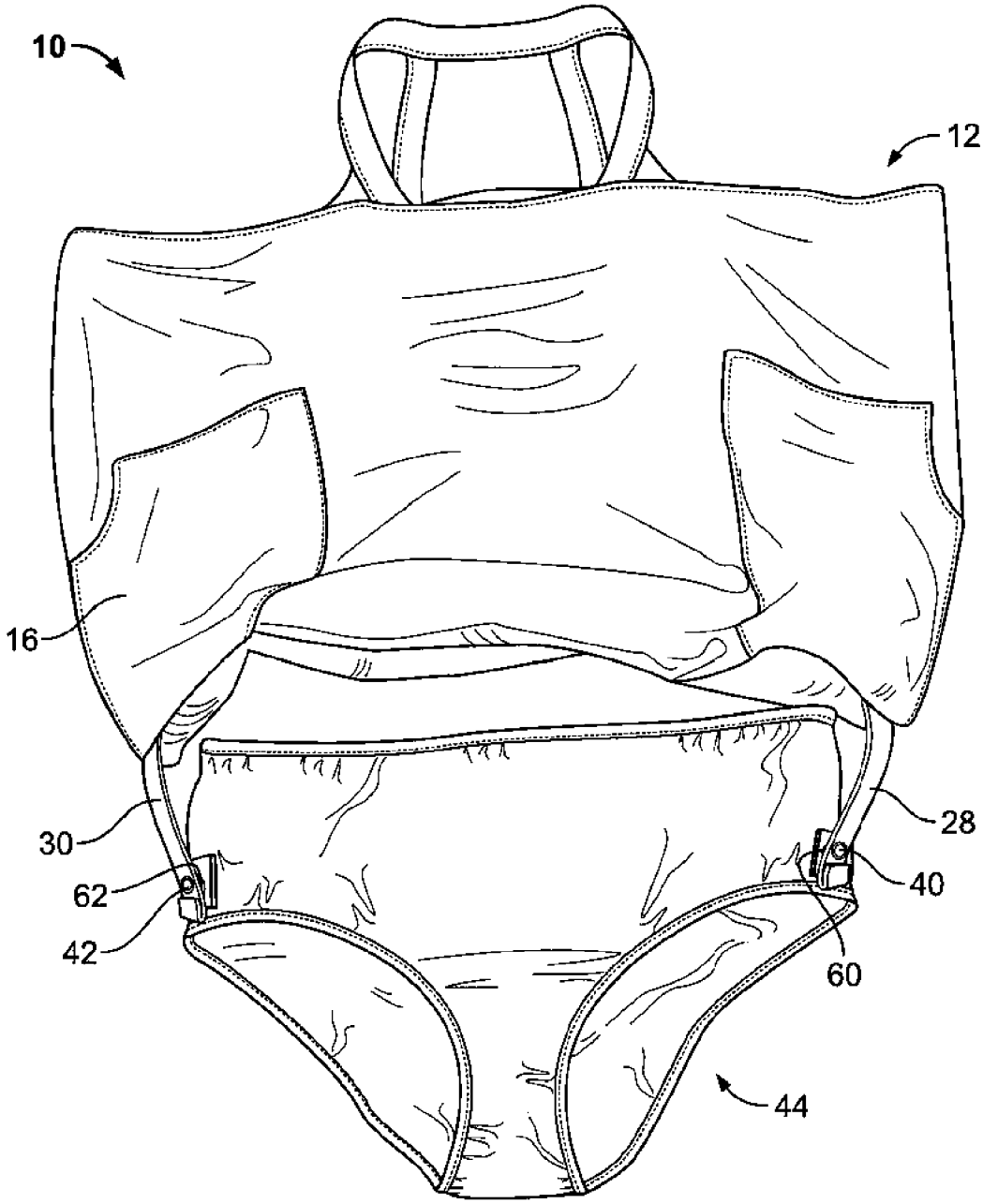
FIG. 7 is a front elevational view of the garment shown in FIGS. 1 through 6, illustrating the tethering system facilitating attachment of the outer garment to the undergarment.
Figure 8:
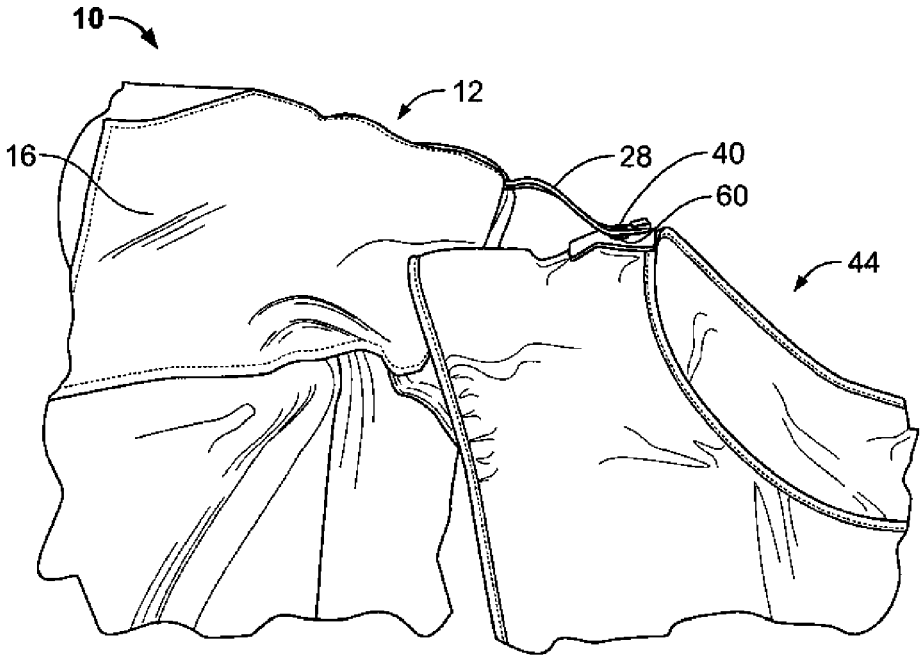
FIGS. 8 and 9 are close-up views of the tethering system shown in FIG. 7.
Figure 9:
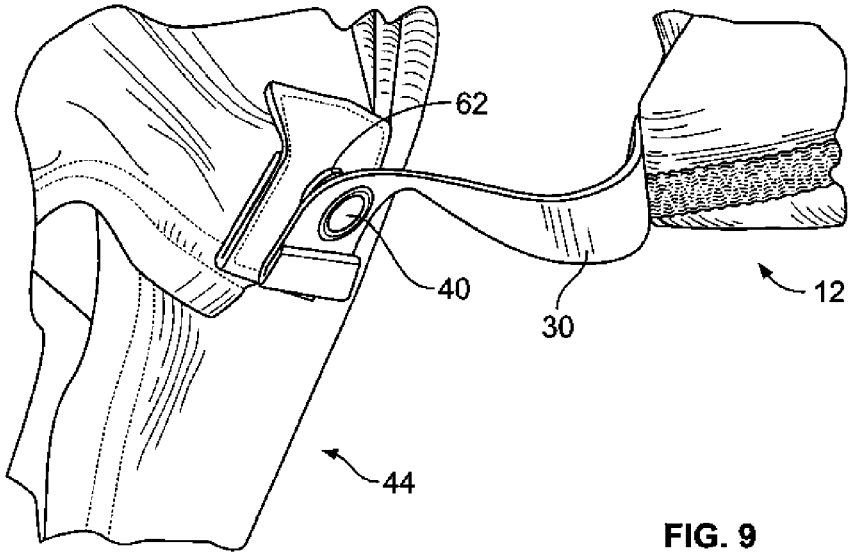

FIGS. 5 and 6 show the outer garment 12 and the undergarment 44 detached from one another. In an embodiment, a user puts on the undergarment 44 and the outer garment 12. Next, the user may roll up the skirt portion 16 of the outer garment 12 until the tethers 28, 30 are located and available to be grasped and manipulated by the user. In an embodiment, the user attaches the outer garment 12 to the undergarment 44 by engaging the first fastening element 40 of the tether 28 with the second fastening element 60 of the undergarment 44, and engaging the first fastening element 42 of the tether 30 with the second fastening element 62 of the undergarment 44, as shown in FIGS. 7 through 9. When the outer garment 12 is attached to the undergarment 44 in this manner, the skirt portion 16 can be released and allowed to "fall" into its intended shape. In this regard, the lengths of the tethers 28, 30 allow the skirt portion 16 to fall into shape and enable the garment 10 to maintain its aesthetic look and function, while inhibiting it to cling to the user. In an embodiment, when the garment 10 is a bathing dress, and when a user is bathing in a body of water, the tethers 28, 30 provide leeway and pull, due to their flexibility and elasticity, to inhibit the undergarment 44 and/or the bottom of the skirt portion 16 from floating up on the surface of the water and prevent unwanted visual exposure of the user's lower extremities. In an embodiment, a user may remove the undergarment 44 from the outer garment 12 without having to remove the outer garment 12 (e.g., to utilize the bathroom or for other reasons) by disengaging the first fastening elements 40, 42 from the second fastening elements 60, 62, thus allowing the user to slip out of the undergarment 44.

Figure 10:
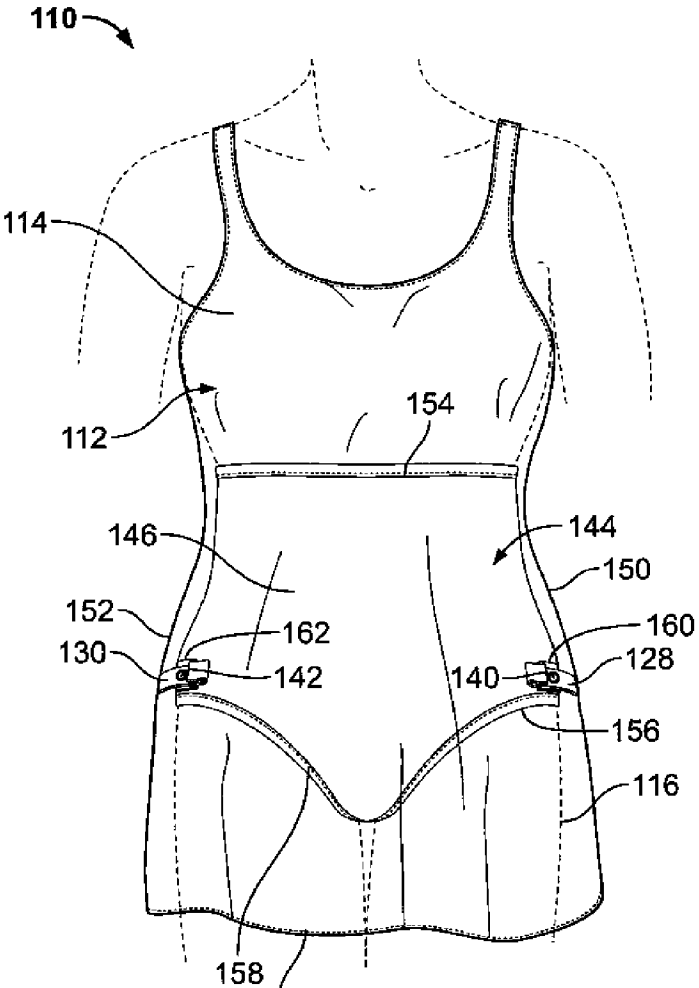
FIG. 10 is a front elevational view of a garment constructed in accordance with another embodiment of the present invention.

FIG. 10 shows a garment 110 constructed in accordance with another embodiment of the present invention. In an embodiment, the garment 110 is a dress. In another embodiment, the garment 110 is a bathing dress. In an embodiment, the garment 110 is a one-piece bathing dress. In an embodiment, the garment 110 is constructed and functions similarly to the garment 10, with the foregoing differences. In an embodiment, the garment 110 includes a first portion 112 having a bust portion 114, an under portion 144 integral with the first portion 112, and a skirt portion 116 attached to and extending downwardly from the first portion 112. In an embodiment, the skirt portion 116 is attached to the first portion 112 intermediate the bust portion 114 and the under portion 144 such that the skirt portion 116 covers the under portion 144 when the garment 110 is in use.

With continued reference to FIG. 10, in an embodiment, an inner side of the skirt portion 116 includes a pair of tethers 128, 130 extending therefrom. In an embodiment, the tethers 128, 130 are diametrically opposed to one another. In an embodiment, the tethers 128, 130 are attached to the inner side of the skirt portion 116 at locations intermediate the hip of the user and a bottom end 117 of the skirt portion 116 when she wears the garment (see FIG. 10). In an embodiment, each of the tethers 128, 130 includes a first fastening element 140, 142, respectively, at the second end thereof, which have been described above in detail with respect to the garment 10.

With continued reference to FIG. 10, in an embodiment, the under portion 144 includes a front panel 146, left and right side portions 150, 152, a waist portion 154, and leg openings 156, 158. In an embodiment, the front panel 146 includes a pair of second fastening elements 160, 162. In an embodiment, the second fastening element 160 is positioned on the left side portion 150 proximate to the leg opening 156, while the second fastening element 162 is positioned on the right side portion 152 proximate to the leg opening 158. As described in detail with respect to the garment 10, the first fastening elements 140, 142 of the tethers 128, 130 engage releasably the second fastening elements 160, 162 of the under portion 144.

Figure 11:
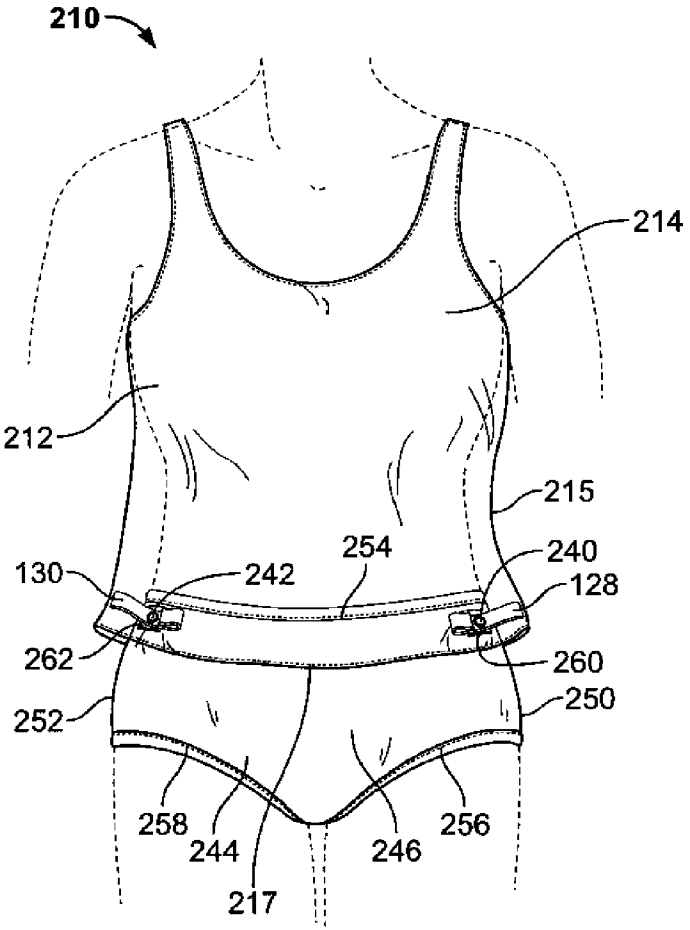
FIG. 11 is a front elevational view of a garment constructed in accordance with another embodiment of the present invention.

FIG. 11 shows a garment 210 constructed in accordance with another embodiment of the present invention. In an embodiment, the garment 210 is a bathing suit. In an embodiment, the garment 210 is a "tankini." In an embodiment, the garment 210 is constructed and functions similarly to the garment 10, with the foregoing differences. In an embodiment, the garment 210 includes a tank top portion 212 having a bust portion 214, a tank cover 215 attached to and extending downwardly from the bust portion 214, and a bottom portion 244. In an embodiment, the tank cover 215 extends just below a waist portion 254 of the bottom portion 244. In an embodiment, the bottom portion 244 is a bikini bottom. In another embodiment, the bottom portion 244 is a skirted bottom.

With continued reference to FIG. 11, in an embodiment, an inner side of the tank cover 215 includes a pair of tethers 228, 230 extending therefrom. In an embodiment, the tethers 228, 230 are diametrically opposed to one another. In an embodiment, the tethers 228, 230 are attached to the inner side of the tank cover 215 at locations intermediate the hip of the user and a bottom end 217 of the tank cover 215 then she wears the garment 210 (see FIG. 11). In an embodiment, each of the tethers 228, 230 includes a first fastening element 240, 242, respectively, at the second end thereof, which have been described above with respect to the garment 10.

With continued reference to FIG. 11, in an embodiment, the bottom portion 244 includes a front panel 246, left and right side portions 250, 252, a waist portion 254, and leg openings 256, 258. In an embodiment, the front panel 246 includes a pair of second fastening elements 260, 262. In an embodiment, the second fastening element 260 is positioned on the left side portion 250 intermediate the waist portion 254 and the leg opening 256, while the second fastening element 262 is positioned on the right side portion 252 intermediate the waist portion 254 and the leg opening 258. As described in detail with respect to the garment 10, the first fastening elements 240, 242 of the tethers 228, 230 engage releasably the second fastening elements 260, 262 of the bottom portion 244.

Figure 12:
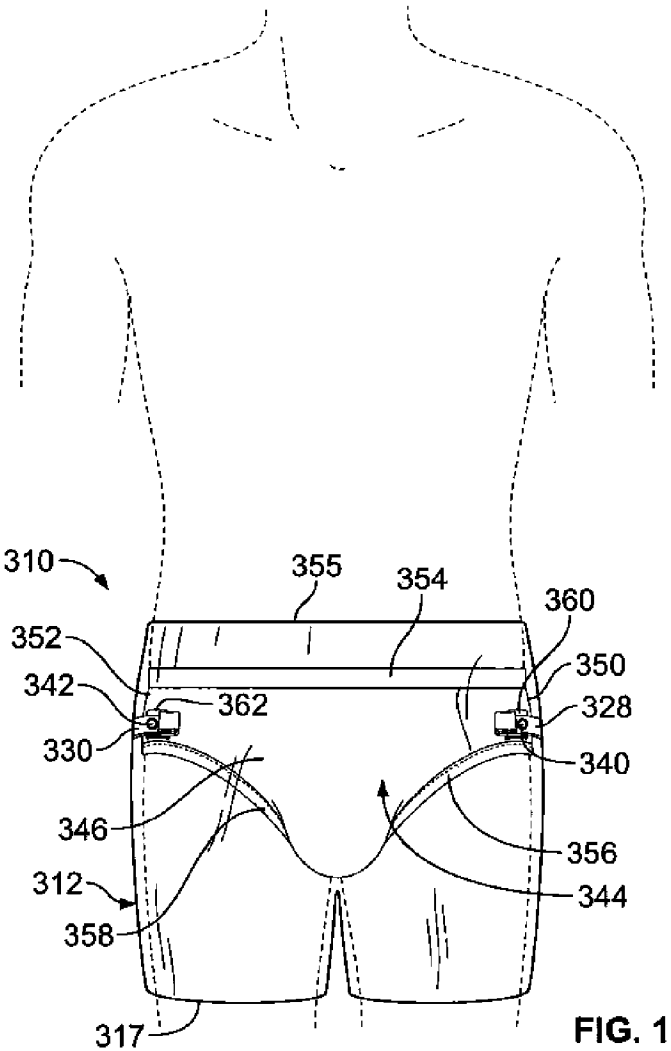
FIG. 12 is a front elevational view of a garment constructed in accordance with another embodiment of the present invention.

FIG. 12 shows a garment 310 constructed in accordance with another embodiment of the present invention. In an embodiment, the garment 310 is a men's bathing suit. In an embodiment, the garment 310 is constructed and functions similarly to the garment 10, with the foregoing differences. In an embodiment, the garment 310 includes an outer garment 312 and an undergarment 344. In an embodiment, the outer garment 312 is swimming trunks. In another embodiment, the outer garment 312 is board shorts. In other embodiments, the outer garment 312 consists of other designs, styles, shapes and sizes. In an embodiment, the undergarment 344 is a swim brief. In other embodiments, the undergarment 344 consists of other designs, styles, shapes and sizes.

With continued reference to FIG. 12, in an embodiment, an inner side of the undergarment 312 includes a pair of tethers 328, 330 extending therefrom. In an embodiment, the tethers 328, 330 are diametrically opposed to one another. In an embodiment, the tethers 328, 330 are attached to the inner side of the undergarment 312 at locations intermediate a waistline 355 and a bottom end 317 of the undergarment. In an embodiment, each of the tethers 328, 330 includes a first fastening element 340, 342, respectively, at the second end thereof, which have been described above with respect to the garment 10.

With continued reference to FIG. 12, in an embodiment, the undergarment 344 includes a front panel 346, left and right side portions 350, 352, a waist portion 354, and leg openings 356, 358. In an embodiment, the front panel 346 includes a pair of second fastening elements 360, 362. In an embodiment, the second fastening element 360 is positioned on the left side portion 350 intermediate the waist portion 354 and the leg opening 356, while the second fastening element 362 is positioned on the right side portion 352 intermediate the waist portion 354 and the leg opening 358. As described in detail with respect to the garment 10, the first fastening elements 340, 342 of the tethers 328, 330 engage releasably the second fastening elements 360, 362 of the undergarment 344.

Figure 13:
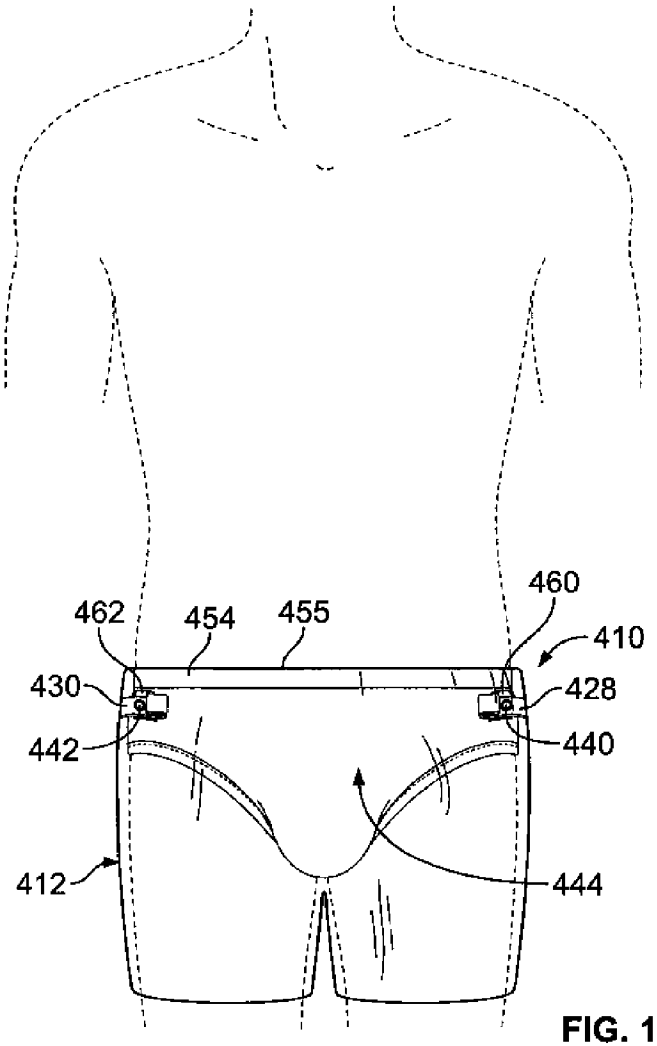
FIG. 13 is a front elevational view of a garment constructed in accordance with another embodiment of the present invention.

FIG. 13 shows a garment 410 constructed in accordance with another embodiment of the present invention. In an embodiment, the garment 410 includes an outer garment 412 having tethers 428, 430 with first fastening elements 440, 442, respectively, and an undergarment 444 having second fastening elements 460, 462 that engage releasably the first fastening elements 440, 442. In an embodiment, the garment 410 is a men's bathing suit. In an embodiment, the outer garment 412 is swimming trunks. In another embodiment, the outer garment 412 is board shorts. In other embodiments, the outer garment 412 consists of other designs, styles, shapes and sizes. In an embodiment, the undergarment 444 is a swim brief. In other embodiments, the undergarment 444 consists of other designs, styles, shapes and sizes. In an embodiment, the garment 410 is constructed and functions similarly to the garment 310, with the exception that the tethers 428, 430 are located proximate to a waistline 455 of the outer garment 312, and the second fastening elements 460, 462 are located proximate to a waistline 454 of the undergarment 444. In an embodiment, the waistline 455 of the outer garment 412 and the waistline 454 of the undergarment 444 are substantially aligned with one another when the user is wearing the garment 410. In another embodiment, the waistline 455 of the outer garment 412 sits slightly below the waistline 454 of the undergarment 444 when the user is wearing the garment 410. In another embodiment, the waistline 455 of the outer garment 412 sits slightly above the waistline 454 of the undergarment 444 when the user is wearing the garment 410.

It will be understood that the embodiments described herein are merely exemplary and that a person skilled in the art may make many variations and modifications without departing from the spirit and scope of the invention, many of which are described above. For example, as indicated above, each of the first fastening elements 40, 42 and the second fastening elements 60, 62 includes other fastening elements and systems known in the art, such as buttons/buttonholes, hook and eye fasteners, zippers, pins, and VELCRO® hook and loop fasteners. In other embodiments, the first fastening elements 40, 42 and the second fastening elements 60, 62 can be made of suitable materials known in the art. In an embodiment, the lengths of the tethers 28, 30 are selected to accommodate different sizes of the garment 10. In an embodiment, while the garment 10 is suitable for use as a bathing dress, it can be suitable for use as a formal or an informal dress. In an embodiment, while the garments 310, 410 are suitable for use as a men's swimsuit, they can be suitable for use as men shorts. In other embodiments, the tethering system described above can be used in connection with other types of garments, outer garments, and undergarments. All such variations and modifications are intended to be included within the scope of the invention as defined in the appending claims.

What is claimed is:

1. A garment, comprising:

an outer garment having a shorts portion with an inner side, a first side seam located on said inner side, a second side seam located on said inner side and opposite said first side seam, and a pair of tethers extending from said inner side, each of said pair of tethers including a first end and a second end opposite said first end, said first end of one of said pair of tethers being attached to said first side seam of said shorts portion, and said first end of the other of said pair of tethers being attached to said second side seam of said shorts portion, and each of said pair of tethers being made from an elastic material and including a first fastening element located at said second end thereof; and an undergarment having a pair of second fastening elements, wherein each of said first fastening elements of said pair of tethers of said shorts portion is adapted to engage releasably a corresponding one of said second fastening elements of said undergarment.

2. The garment of claim 1, wherein said undergarment includes a front panel, and wherein said second fastening elements are positioned on said front panel.

3. The garment of claim 2, wherein said undergarment includes a rear panel opposite said front panel, said front and rear panels forming left and right side portions, a waist portion, and left and right leg openings, and wherein one of said pair of second fastening elements is positioned proximate to said left side portion intermediate said waist portion and said left leg opening, and the other of said pair of second fastening elements is positioned proximate to said right side portion intermediate said waist portion and said right leg opening.

4. The garment of claim 1, wherein each of said first fastening elements of said tethers of said shorts portion of said outer garment includes a female snap element, and each of said second fastening elements of said undergarment includes a male snap element.

5. The garment of claim 1, wherein each of said first fastening elements of said tethers of said shorts portion of said outer garment includes a male snap element, and each of said second fastening elements of said undergarment includes a female snap element.

6. The garment of claim 1, wherein each of said first fastening elements of said tethers of said shorts portion of said outer garment and said second fastening elements of said undergarment are selected from the group consisting of buttons, hook and eye fasteners, pins, zippers, and hook and loop fasteners.

7. The garment of claim 1, wherein said garment is a men's swimsuit.

8. The garment of claim 1, wherein said garment is men's shorts.

9. A garment, comprising:

an outer garment having a shorts portion with an inner side and a pair of elastic tethers extending from said inner side, each of said tethers including a first end and a second end opposite said first end, said first ends of said tethers being attached to said inner side of said shorts portion, and each of said tethers including a first fastening element located at said second end thereof; and an undergarment having a front panel and a rear panel opposite said front panel, said front and rear panels forming left and right side portions, a waist portion, and left and right leg openings, and second fastening elements, one of which is positioned on said front panel proximate to said left side portion and intermediate said waist portion and said left leg opening, and the other of which is positioned on said panel proximate to said right side portion and intermediate said waist portion and said right leg opening, wherein each of said first fastening elements of said tethers of said shorts portion of said outer garment is adapted to engage releasably a corresponding one of said second fastening elements of said undergarment.

10. The garment of claim 9, wherein each of said first fastening elements of said tethers of said shorts portion of said outer garment includes a female snap element, and each of said second fastening elements of said undergarment includes a male snap element.

11. The garment of claim 9, wherein each of said first fastening elements of said tethers of said shorts portion of said outer garment includes a male snap element, and each of said second fastening elements of said undergarment includes a female snap element.

12. The garment of claim 9, wherein each of said first fastening elements of said tethers of said shorts portion of said outer garment and said second fastening elements of said undergarment are selected from the group consisting of buttons, hook and eye fasteners, pins, zippers, and hook and loop fasteners.

13. The garment of claim 9, wherein said garment is a men's swimsuit.

14. The garment of claim 9, wherein said garment is shorts.

* * * * *